United States Patent [19]

Geschka

[11] 4,353,052

[45] Oct. 5, 1982

[54] IRON CORE WITH PLANISHED CLAMPING SURFACES FOR ELECTRIC MACHINE, SUCH AS TRANSFORMER, CHOKE, VOLTAGE STABILIZER OR THE LIKE

[75] Inventor: Hugo-Werner Geschka, Düsseldorf, Fed. Rep. of Germany

[73] Assignee: E. Blum GmbH & Co., Vaihingen, Fed. Rep. of Germany

[21] Appl. No.: 50,791

[22] Filed: Jun. 21, 1979

[30] Foreign Application Priority Data

Jun. 21, 1978 [DE] Fed. Rep. of Germany ..... 2827179

[51] Int. Cl.[3] ..... H01F 27/26

[52] U.S. Cl. ..... 336/210

[58] Field of Search ..... 336/210, 100, 216, 217, 336/219, 212; 310/217, 218

[56] References Cited

U.S. PATENT DOCUMENTS

| | | | |
|---|---|---|---|
| 581,873 | 5/1897 | Thomson | 336/210 X |
| 2,293,951 | 8/1942 | Seastone et al. | 336/216 |
| 2,425,622 | 8/1947 | Kronmiller | 336/210 X |
| 2,674,721 | 4/1954 | Jackson et al. | 336/210 X |
| 3,138,774 | 6/1964 | Derbyshire et al. | 336/210 |
| 3,238,404 | 3/1966 | Spiess | 336/210 X |
| 3,341,793 | 9/1967 | Wale et al. | 336/210 X |
| 3,349,357 | 10/1967 | McNutt et al. | 336/210 |
| 3,419,836 | 12/1968 | Aldridge, Jr. | 336/210 |

*Primary Examiner*—Thomas J. Kozma

*Attorney, Agent, or Firm*—Kontler, Grimes & Battersby

[57] ABSTRACT

Iron core for an electric machine such as a transformer, a choke, a voltage stabilizer and the like, assemblable of a plurality of individual parallelepipedal core parts formed of laminated layers mutually held together, the core parts having mutually abutting joints formed with smoothly finished surfaces free of any metallic connection between the individual layers, includes clamping means applicable to a clamping surface at outer contours of the core and extending transversely to the laminated layers, clamping elements for clamping the clamping means so as to hold the individual core parts together, the clamping means includes strap-like members for distributing clamping force at least approximately uniformly to the individual laminated layers between the clamping means and the respective clamping surface.

4 Claims, 1 Drawing Figure

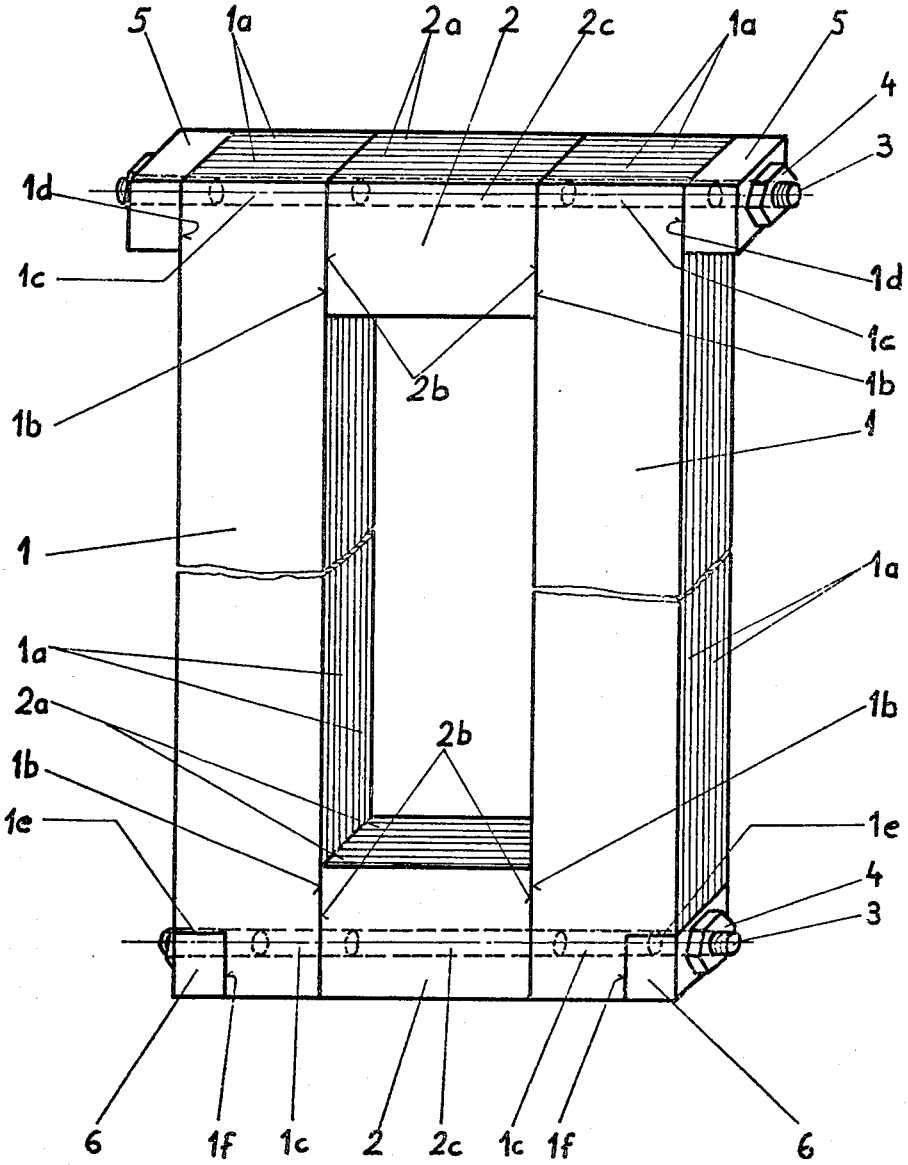
5
1a
2a
2
2c
1a
5
4
3
1d
1c
1d
1c
1b
2b
1b
1
1
1a
1a
2a
2b
1b
1b
1e
1e
4
3
6
1f
1c
2
2c
1c
1f
6

IRON CORE WITH PLANISHED CLAMPING SURFACES FOR ELECTRIC MACHINE, SUCH AS TRANSFORMER, CHOKE, VOLTAGE STABILIZER OR THE LIKE

The invention relates to an electric machine such as a transformer, choke, voltage stabilizer or the like and, more particularly, to an iron core therefor assemblable of a plurality of individual core parts formed of laminated layers mutually held together, especially cemented together, the core parts having mutually abutting joints, and the joints, if formed by material removal such as a grinding operation, being subjectible to an operation for removing any metallic connection such as a grinding burr that may have been formed between the individual layers, clamping means applicable to a clamping surface at outer contours of the core and extending transversely to the lamination layers, such clamping means being, for example, clamping straps, clamping plates or the like, and clamping elements such as screws, rivets or the like, for clamping the clamping means so as to hold the individual core parts together.

It has been found that it is not always possible, when the individual core parts are stacked and subsequently glued together, to place the laminations on top of each other in such a manner that the contours come to lie in one plane so that a variable magnetic reluctance exists between the abutting joints. Efforts have accordingly been made to even out or smooth the joints. However, it has been found that the individual laminations can shift relative to one another in the course of time, promoted by the action of the heat produced by demagnetization of the iron, whereby tiny air gaps can form so that the joint surfaces no longer fully rest upon one another. This increases the magnetic transition reluctance or contact resistance and a higher field strength is required to overcome it. Greater magnetizing currents, more stray losses and more heating-up are consequences thereof.

It is accordingly an object of the invention of the instant application to provide an iron core for electric machines, such as transformers, chokes, voltage stabilizers and the like wherein such disadvantages of the heretofore known iron cores are avoided and to provide an iron core which is distinguished by high efficiency, extremely low noise and low operating temperature.

According to the invention, this is achieved with iron cores for electric machines of the type mentioned at the introduction to this specification by providing measures for at least approximately uniformly distributing the clamping pressure to the individual lamination layers between the clamping means and the clamping surface.

In accordance with another feature of the invention, this is achieved, for example, by providing a plastically and elastically deformable material, such as rubber, for example, which equalizes or compensates at least approximately the unevennesses between the clamping means and the clamping surfaces so as to distribute the clamping force at least approximately uniformly over the individual layers.

In accordance with a further feature of the invention, the clamping surfaces of the individual core parts, on which the clamping means are applicable, are equalized or planished.

In accordance with an added feature of the invention, this is accomplished by removing material at the clamping surfaces; any metallic connections between the individual laminations caused by the material removal operation, for example, grinding burr, being then removed by a mechanical treatment, such as lapping, ball or shot blasting, sandblasting, tumbling or the like or by an electrolytic material removing process.

In accordance with an additional feature of the invention, the surfaces of the clamping means per se i.e. of the clamping strips or straps or the like, which are disposable on the clamping surfaces, are likewise equalized or planished.

In accordance with yet another feature of the invention, the respective individual core parts are formed with recesses defined by suitably formed clamping surfaces for receiving the clamping means therein. These recesses are further provided, in accordance with the invention, in magnetically neutral zones which has the advantage of affording a space-saving compact construction.

In accordance with yet further features of the invention, a foreign-material insert, such as an insulating foil is disposed between the clamping surfaces and the clamping means in order to eliminate electromagnetic short circuits which might otherwise be caused by the clamping means.

In accordance with yet an added feature of the invention, an insert of plastic and elastically deformable material is disposed between the clamping means and the respective clamping surface for at least approximately equalizing unevennesses between the clamping means and the clamping surface and for at least approximately uniformly distributing clamping force to the individual laminated layers.

In accordance with yet an additional feature of the invention, the individual laminated layers of the respective core parts extend parallel to one another, and the core parts are formed with recesses for receiving the clamping elements therein, the recesses extending parallel to the laminated layers of all of the core parts, and being formed especially by a chip-removing machining operation.

In accordance with a concomitant feature of the invention, the core parts are formed of legs and intermediate yoke parts located between the legs, the surface of the joints of the legs and the respective clmaping surface located at the outer contour of the respective legs being formed by similar treatment.

Other features which are considered as characteristic for the invention are set forth in the appended claims.

Although the invention is illustrated and described herein as embodied in iron core for electric machine, such as transformer, choke, voltage stabilizer or the like, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing in which the single FIGURE is a perspective view of an iron core for a transformer in accordance with the invention.

Referring now to the drawing, there is shown in the FIGURE an iron core I formed of leg core parts 1 and intermediate yoke parts 2 located therebetween. The core parts 1 and 2 are, in turn, formed of laminated individual metal sheets or plates 1*a*, 2*a*, which are cemented together. The leg core parts 1 as well as the intermediate yoke parts 2 each have abutting joints 1*b* and 2*b*, respectively, formed thereon by which they engage one another. These abutting joints 1*b*, 2 *b* are advantageously smoothed out by a material-removing process, such as a grinding operation, for example, and are subsequently subjected to a treatment by which the previously formed metallic bonds or connections, such as grinding burr, for example, are removed. Such a treatment may be sand blasting, for example.

The iron core I is held together by means of clamping or gripping elements which, in the embodiment of the instant application, are screws and nuts 3 and 4, the screws 3 extending through bores 1*c* formed in the legs 1 and bores 2*c* in the intermediate yoke parts 2.

It is apparent that the bores 1*c* and 2*c* as well as all individual lamination layers 1*a* and 2*a* of all the core parts are disposed parallel to one another.

In order to maintain optimally uniform contact pressure between the abutting joints 1*b* and 2*b*, clamping means, namely clamping strips or straps 5, are provided between the nuts 4 and the corresponding clamping surfaces 1*d* shown in the upper region of the iron core, as viewed in the FIGURE.

In the lower region of the iron core, as viewed in the FIGURE, the clamping straps 6 are received or sunk in a recess 1*e* formed in the legs, indeed, in a magnetically inactive zone.

The clamping straps or strips 6 engage the legs 1 through a clamping surface 1*f* formed on the legs 1, and thereby clamp the core.

In order to attain optimally uniform pressure distribution and thereby optimal electrical properties and optimal efficiency, and in order to avoid humming noises, the clamping surfaces 1*d* and 1*f* are smoothed or planished, as can also be the case with the joints 1*b* and 2*b*, so that no individual laminations projecting beyond one another are present any longer. The smoothing or equalizing can be accomplished, for example, by grinding, and it is advantageous if the flash or burr formed thereby, such as grinding burr, for example, is removed by a further treatment, such as by sand blasting, for example.

In order to remove irregularities or unevenesses that may be present at the contact locations of the clamping straps or strips 5, the sides of the clamping strips or straps 5 resting against the clamping surfaces can be smoothed or evened off.

It is further possible to place a spacer, for example, of magnetically non-conductive material between the straps or strips 5 and 6 and the clamping surfaces 1*d* and 1*f*, respectively.

Such a spacer, if formed of elastically deformable material, can, however, effect an at least approximately uniform distribution of the clamping pressure over the individual lamination layers.

There are claimed:

1. Iron core for an electric machine such as a transformer, a choke, a voltage stabilizer and the like, assembled of a plurality of individual parallelipipedal core parts formed of laminated layers mutally held together, the core parts having mutually abutting joints formed with smoothly finished surfaces free of any metallic connection between the individual layers, comprising clamping means applied to a planished clamping surface at outer contours of the core and extending transversely to the laminated layers, clamping elements clamping said clamping means so as to hold the individual core parts together, said clamping means being means for distributing clamping force at least approximately uniformly to the individual laminated layers between said clamping means and the respective planished clamping surface.

2. Iron core according to claim 1 wherein the surface of the clamping means which are applied to the planished clamping surface of the respective individual core parts is also planished.

3. Iron core according to claim 1 or 2 wherein the respective individual core parts are formed with recesses extending transversely to the laminated layers thereof and defined by suitably-formed clamping surfaces receiving said clamping means therein.

4. Iron core according to claim 1 or 2 wherein the individual laminated layers of the respective core parts extend parallel to one another, and the core parts are formed with recesses receiving said clamping elements therein, said recesses extending parallel to the laminated layers of all of the core parts.

* * * * *